United States Patent [19]

Lupinski et al.

[11] 4,188,413

[45] Feb. 12, 1980

[54] ELECTROSTATIC-FLUIDIZED BED COATING OF WIRE

[75] Inventors: John H. Lupinski, Scotia; Bernard Gorowitz, Elnora, both of N.Y.

[73] Assignee: General Electric Company, Schenectady, N.Y.

[21] Appl. No.: 871,153

[22] Filed: Jan. 20, 1978

Related U.S. Application Data

[62] Division of Ser. No. 733,236, Oct. 18, 1976, Pat. No. 4,100,883.

[51] Int. Cl.[2] ..... B05D 1/06; B05B 5/02; B05D 7/20

[52] U.S. Cl. ..... 427/30; 427/32

[58] Field of Search ..... 427/21, 27, 32, 28, 427/29, 30, 33; 118/DIG. 5, DIG. 19, DIG. 22, 627, 629, 630, 654

[56] References Cited

U.S. PATENT DOCUMENTS

| | | | |
|---|---|---|---|
| 3,248,253 | 4/1966 | Barford et al. | 427/32 X |
| 3,336,903 | 8/1967 | Point | 427/27 X |
| 3,670,699 | 6/1972 | Sargent | 118/629 |
| 3,817,211 | 6/1974 | Brown et al. | 118/DIG. 5 |
| 4,035,521 | 7/1977 | Westervelt et al. | 427/32 |
| 4,069,792 | 1/1978 | Nethersole et al. | 118/634 X |

*Primary Examiner*—Morris Kaplan

*Attorney, Agent, or Firm*—Richard J. Jackson; Joseph T. Cohen; Paul R. Webb, II

[57] ABSTRACT

An elongate electrical conductor is continuously coated with electrostatically charged powder by passing the conductor upwardly through a tube into the upper portion of a container having a charged fluidized bed of the powder in a lower portion thereof. The tube extends upwardly through the bed and the tube height is adjusted relative to the upper surface of the bed to control the thickness of the powder coating. An array of electrodes having associated switches permits application of uniform coatings to conductors having a variety of shapes. Two or more conductors may be uniformly coated from the same fluidized bed in a container having a baffle which divides the upper portion into two or more compartments and spaced apart tubes extend upwardly into the different compartments.

24 Claims, 7 Drawing Figures

ELECTROSTATIC-FLUIDIZED BED COATING OF WIRE

This is a division of application Ser. No. 733,236, filed Oct. 18, 1976, now U.S. Pat. No. 4,100,883.

The present invention relates to a process for continuously coating an elongate electrical conductor.

Insulated magnet wire has typically been made by methods wherein the wire is coated with an enamel solution. These methods are expensive and require evaporation of the enamel solvent. The evaporated solvent is either discarded or recovered only with great difficulty. Attention has recently been directed to electrostatic coating of powder from fluidized beds as a possible replacement for the enamel solution processes. Apparatus and methods for electrostatic fluidized bed coating are disclosed in U.S. Pat. Nos. 3,248,253 (Barford et al.), 3,396,699 (Beebe et al.), and 3,916,826 (Knudsen). Attempts at powder coating of wire have been reported in Powder Finishing World, 1st Quarter, 1975, page 11, and in Insulation Circuits, January 1975, page, 19. Recently, Electrostatic Equipment Corporation introduced electrostatic fluidized bed powder coating equipment in which a wire is moved vertically through a coating chamber. In operation, a substantial amount of gas-entrained powder is created which is either discarded or recovered and recycled with attendant contamination problems. Such contamination is unacceptable in the field of insulated wire where insulation coatings have high electrical integrity are required.

It has now been found by the practice of the present invention that numerous problems of heretofore known methods for coating wire are overcome in simple and efficient manner.

Generally stated, in one aspect, the present invention provides for continuously coating an elongate electrical conductor. Apparatus by which to practice the method comprises a container having a lower portion for containing a fluidized bed of electrically chargeable powder and an upper portion adjoining the lower portion for deposition of electrically charged powder onto the conductor. A hollow member is disposed in the lower portion of the container and provides a passageway from the exterior of the container to the interior of the container. The hollow member has an upwardly extending portion terminating in an open upper end defining an interface between the upper and lower portions of the container. Disposed at a lower end of the lower portion of the container is a porous member adapted to pass a gaseous medium therethrough and upwardly through the bed.

The apparatus includes means for vibrating the container and for cooperating with the gaseous medium to fluidize the bed to an extent such that the fluidized bed has a substantially uniform upper surface below the open upper end of the hollow member. Further included are means for advancing an elongate electrical conductor along a path through the hollow member, upwardly out of the upwardly extending hollow member portion and through the top of the upper container portion. An electrode means operable at an electrical potential different from the electrical potential of the conductor is operably associated with the container to directly or indirectly electrically charge the powder. In operation, charged particles are transferred from the fluidized bed to the conductor in the region of the upper portion of the container adjacently above the open upper end of the hollow member.

Typically, there is substantially no entrainment of powder particles in the fluidizing gaseous medium in the container portion above the fluidized bed, thereby avoiding the problem of prior art devices wherein substantial powder entrainment and need for recovery are present.

In a preferred embodiment, the hollow member is adapted to be axially adjusted relative to the container.

In another preferred embodiment, the apparatus includes a plurality, i.e. two or more, of the hollow members in spaced apart relationship and a barrier means dividing the upper protion of the container into a plurality of compartments equal in number to the number of hollow members. Each compartment is above only one of the hollow member open upper ends. The barrier means has a lower end spaced above the porous member, the lower end being lower than each hollow member upper end. In this embodiment, the apparatus is eminently suitable for simultaneously coating a plurality of elongate electrical conductors, each conductor passing through a different hollow member into a different compartment.

In another aspect, generally stated, the present invention provides a process for continuously applying a controlled thickness coating on an elongate electrical conductor, comprising the steps of providing an upwardly extending hollow member having an upwardly facing port, providing a bed of powder about the hollow member, fluidizing the bed to an extent such that the upper surface of the bed is below the port, and electrically charging the fluidized bed with an electrical potential different from the electrical potential of the conductor. The conductor is advanced along a path through the hollow member and upwardly out of the port to effect coating of the powder thereon. Preferably, the height of the port above the upper surface of the bed is adjusted to control the thickness of the powder coating.

Practice of the present invention will become more fully apparent by having reference to the following detailed description taken in connection with the accompanying drawings wherein.

Figure 1:
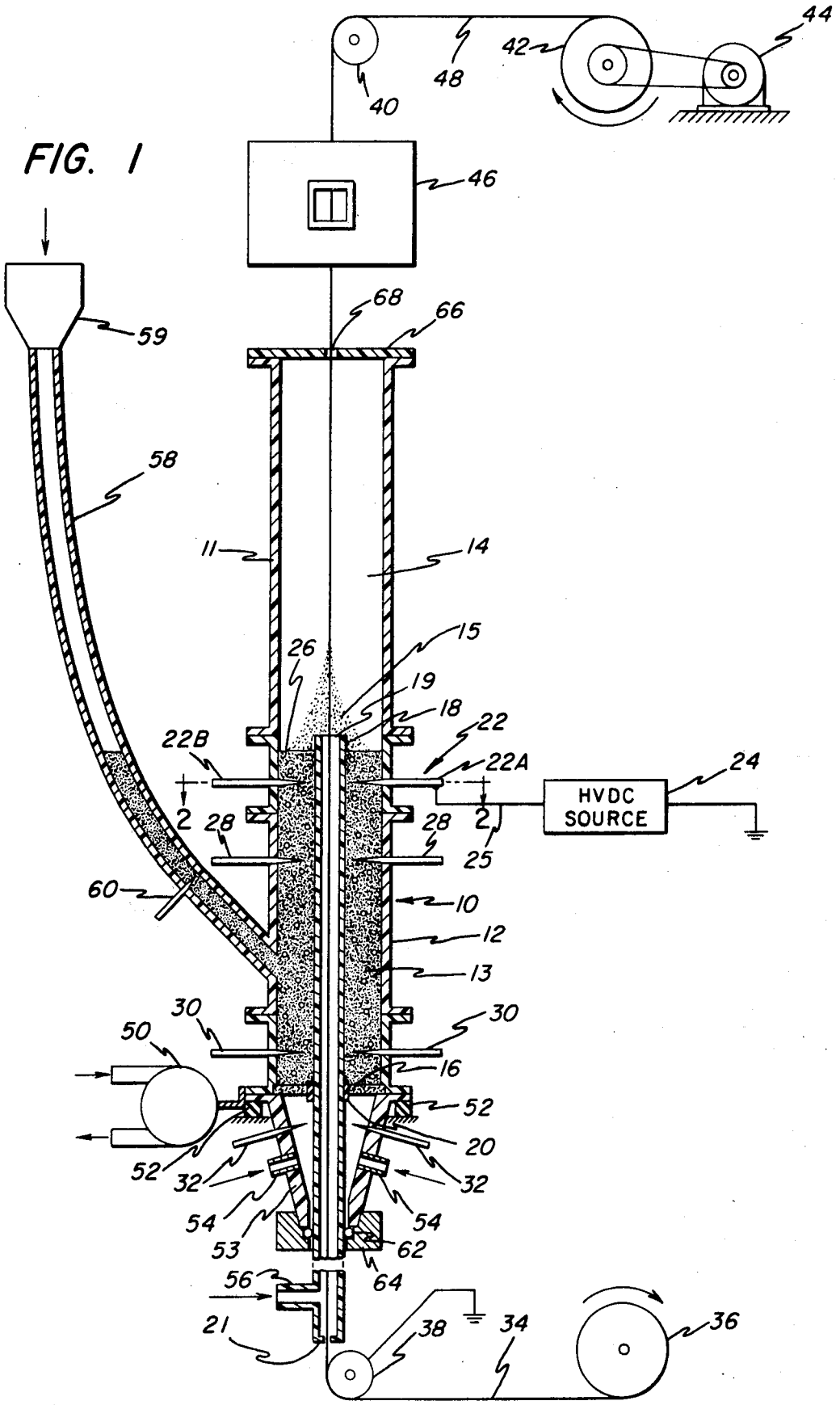
FIG. 1 is an elevation view, partly in section, of the coating apparatus of this invention.

Referring now to the drawing, and especially FIG. 1, there is shown container 10 having upwardly extending wall 11, lower portion 12 in which is contained fluidized bed 13 of electrically chargeable pulverulent material or powder and an upper portion 14 adjoining the lower portion for deposition of electrically charged powder 15 onto wire 34. Porous plate 16, which may be of porous polyethylene or other material which is permeable to gas, is provided at a lower end of the lower portion of the container.

Figure 2:
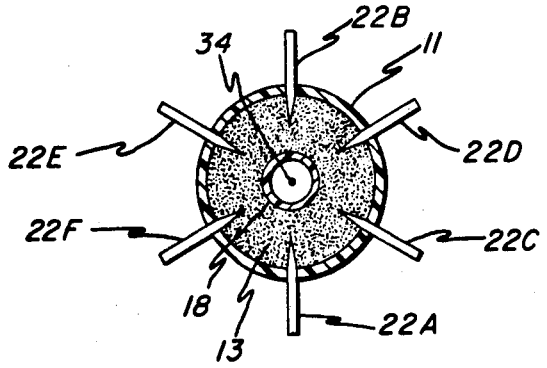
FIG. 2 is a sectional view taken on line 2—2 of FIG. 1, illustrating an array of electrodes.

The container may have any suitable shape, including cylindrical as illustrated in FIGS. 1 and 2. Cover 66 having hole 68 through which a coated elongate conductor may be passed may be removably secured to the top of the container.

Hollow member or tube 18 is preferably slidably received through annular seal 20 which is mounted in an opening through the porous plate. The seal may be snugly engageable with the tube to secure the tube in position. The tube has an open upper end or port 19 which defines an interface between the upper and lower container portions. The tube extends upwardly, preferably vertically, from inlet end 21 disposed exteriorly of the container to port 19 and provides a passage way from the exterior to the interior of the container. The outer surface of the tube portion within the container is spaced inwardly from the inner surface of the upwardly extending wall of the container, thereby providing an annular cavity in which the fluidized bed essentially completely surrounds the tube.

The container and tube are each preferably constructed of non-conductive material. A highly suitable material for the container construction is plexiglass. The tube is desirably formed of Lexan ® polycarbonate resin, which is commercially available from General Electric Company.

The electrode means operably associated with the container preferably includes array 22 of two or more angularly spaced apart electrodes 22A and 22B disposed in the lower portion of the container slightly below the upper surface 26 of the fluidized bed, i.e., immersed within the bed. As shown in greater detail in the sectional plan view of FIG. 2, electrode array 22 may include a plurality of generally horizontal angularly spaced apart electrodes, illustrated by six electrodes 22A, 22B, 22C, 22D, 22E and 22F, each projecting radially inwardly toward upwardly extending tube 18 in the lower portion of the container. Each of these electrodes is adjustably mounted in wall 11 of container 10, as by mating threaded connections, such that the radial distances from the tube to the electrodes can be varied. The angular spacing between adjacent electrodes is preferably uniform such that, when the radial distance from the tube to each electrode is the same, the inner ends or points of the electrodes are at apexes of a regular polygon, which is a hexagon in the illustrated arrangement. When covered by a fluidized bed and all the electrodes are energized, this electrode array is eminently suitable for applying a powder coating of uniform radial thickness circumferentially about electrically conductive wire which is generally circular in cross-section. The electrodes may be of any suitable shape, e.g. pointed members of generally conical configuration. The various electrodes are adapted to be connected electrically to the negative or positive terminal and preferably to the negative terminal of a high voltage DC generator 24. A representative connection is shown by lead 25 from electrode 22A to the generator 24.

The voltage applied to the electrodes may be either negative or positive relative to ground and may be in the range of from about 5 to about 75 or more kilovolts, preferably from about 15 to about 50 kilovolts. The electrical charge applied to the electrodes is transferred to at least a portion of the powder in the fluidized bed.

Take-up roll 42, rotatably driven by motor 44, is provided for advancing an elongate electrical conductor illustrated by wire 34 which may be, for example, copper or aluminum, from supply roll 36 around electrically grounded pulley 38, upwardly through the tube 18, upwardly through the port 19, upwardly through the upper container portion 14, through hole 68, through furnace 46, and around pulley 40 to the take-up roll. The grounded pulley maintains the wire at ground electrical potential.

The furnace, which is schematically illustrated in FIG. 1, is provided above the container for fusing the layer of powder applied to the wire in the container.

A means for vibrating the container is provided, as illustrated by air-operated vibrator 50 which may be connected to the container by any suitable fastening means. The container is supported by shock absorbant supports 52 which may be formed of rubber or other resilient material.

The container may include plenum chamber 53 adjacently below the porous plate 16 with one or more inlets 54 through walls of the chamber for introducing a substantially dry fluidizing gaseous medium, for example, air and preferably nitrogen or other inert gas, through the pores of the porous plate and upwardly through the bed of fluidizable powder. Inlet 56 is preferably provided near the lower end of the tube for admitting nitrogen or other gaseous medium as an upward purge for the tube, thereby substantially preventing powder from falling down into the tube.

Compression cap 60 having a hole through which the tube extends is removably secured to the wall of chamber 53 by securing means such as mating threads. A compressible seal means such as rubber O-ring 62 received in a recess of the cap holds the tube in position when the cap is tightened on the chamber wall. The tube can be axially adjusted relative to the container by loosening the cap, axially moving the tube upwardly or downwardly, and tightening the cap.

In operation, fluidizable powder is added to the lower portion of the container to a height slightly below electrode array 22 and thereafter the fluidizing gas, such as nitrogen, is passed upwardly through the porous plate and upwardly through the bed to fluidized the bed with an upper surface above the electrode array 22. It is found that by vibrating the container and the bed contained therein a fluidized bed with a substantially uniform upper surface below the upper end of the tube can be provided using relatively low superficial gas velocities, for example, from about 0.01 to about 0.10 and preferably from about 0.01 to about 0.03 feet per second. When fluidization is attempted using such low gas velocities without vibrating the bed, the upper surface of the bed is typically not uniform. By using a low velocity of the fluidizing gaseous medium, entrainment of powder in the upper portion of the container, that is above the bed, is substantially avoided. This substantially eliminates the need for recovering and recycling entrained powder as typically is required in heretofore known electrostatic fluidized bed coating apparatus. Thin films of insulation having high electrical integrity, i.e., substantially free of pinholes, voids, and other surface irregularities, can thus be formed on electrical conductors by practice of the present invention.

When the advancing grounded wire emerges from the tube into the zone above the upper surface of the fluidized bed the electrically charged particles are attracted to the wire and form a powder coating or layer thereon. The tube aids application of powder coatings of uniform thickness by virtue of separating the wire from the fluidized bed, thereby precluding adhesion of oversized particles such as any localized agglomerates onto the wire. The tube also serves as an insulator to prevent arcing the electrodes to the wire.

The thickness of the powder coating and the thickness of the ultimately fused coating on the wire may be controlled by adjusting the height of the port or open upper end 19 of the tube above the upper surface of the fluidized bed. Increasing the height of the tube relative to the fluidized bed surface decreases the thickness of the powder layer and the resulting fused coating, while decreasing the relative height of the tube increases the coating thickness. The port 19 is maintained above the fluidized bed surface to prevent contact between the bed and the wire being coated.

Desirably, the upper surface of the fluidized bed is maintained at least about 0.2 inch above the electrode array 22. In general, it is found that such minimum height of the bed surface above the electrodes immersed therein is critical in that extreme variations in coating thickness are observed at lower heights of the fluidized bed surface above the electrodes.

The height of the bed may be maintained substantially constant by means of continuously adding makeup powder at a controlled rate through conduit 58 through which the lower portion of the container communicates with a powder feed means such as hopper 59. Desirably, the conduit is provided with electrode 60 which may be electrically connected to the appropriate terminal of a high voltage DC source to electrically charge the make-up powder being added to the bed.

The container may further include in the lower portion thereof additional electrode arrays as illustrated by electrode array 28—28 and electrode array 30—30. The resulting plurality of vertically spaced apart generally horizontal electrode arrays provides a means for further improving uniformity of powder coatings on conductors coated in the apparatus and uniformity of fused films subsequently prepared by fusing the coated powder. Electrode arrays 28—28 and 30—30 may each include a plurality of electrodes arranged in any suitable configuration, e.g. as described above for electrode array 22 with reference to FIG. 2.

In another embodiment, an electrode or array of electrodes, illustrated schematically by electrodes 32—32, is provided in the plenum chamber. In this embodiment, when the plenum electrode or electrodes are connected to a high voltage D.C. generator, fluidizing gas flowed through the plenum acquires an electrical charge which is transferred to powder in the bed as the charged gas flows upwardly therethrough. Uniform coatings may be applied using this electrode arrangement if sufficient voltage is applied. However, it is found that by charging the fluidized bed by means of electrodes immersed therein, such as the electrodes in array 22, powder coating having uniform thickness can be formed using a lower voltage.

Figure 4:
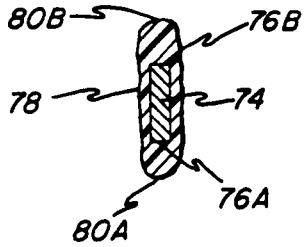
FIG. 4 is a sectional view of a coated rectangular wire having a non-uniform coating.
Figure 5:
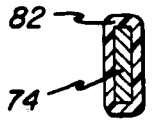
FIG. 5 is a sectional view of a coated rectangular wire having a uniform coating applied in accordance with an embodiment of this invention.
Figure 3:
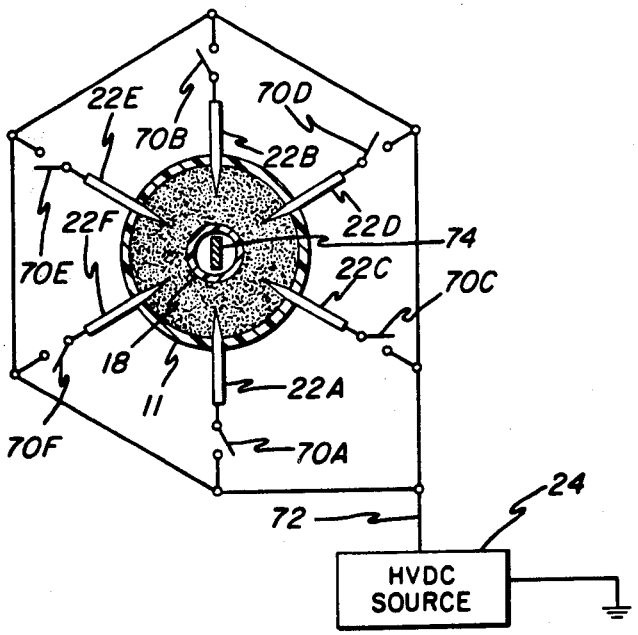
FIG. 3 is a sectional view generally similar to FIG. 2, schematically showing switch means associated with the electrodes.

Insulated wire having insulation coatings of substantially uniform thickness may be prepared by practice of this invention using wire having a variety of shapes, including but not limited to circular, rectangular, and strip. To this end, and referring to FIG. 3, the various uniformly spaced apart electrodes 22A, 22B, 22C, 22D, 22E and 22F of electrode array 22 are preferably provided with switches 70A, 70B, 70C, 70D, 70E, and 70F, respectively, through which selected corresponding electrodes may be connected by common lead 72 to the positive or negative terminal of the high voltage D.C. generator 24. In coating circular wire, switches 70A, 70B, 70C, 70D, 70E and 70F are all preferably closed and all of the electrodes in array 22 are energized, resulting in substantially uniform coating thickness circumferentially about the wire. In coating wire having an elongate cross sectional shape, e.g. cross-sectional length to cross-sectional width ratios of 2:1 or more, it is generally found that, when all the electrodes in array 22 are connected to the high voltage DC generator, the resulting coatings are nonuniform about the wire perimeter, i.e., the opposite narrow ends of the wire are found to have relatively larger coating thickness. FIG. 4 illustrates such an undesirable result for rectangular wire 74 coated in a coating operation wherein opposite narrow ends 76A and 76B are aligned with diametrically opposed electrodes 22A and 22B respectively, and all the electrodes in array 22 are connected through their corresponding switches to the high voltage D.C. generator. As shown in FIG. 4, the coating 78 includes coating regions 80A and 80B of relatively larger thickness at narrow ends 76A and 76B of the rectangular wire. When the coating operation is repeated with the narrow wire ends 76A and 76B aligned with electrodes 22A and 22B, respectively, the switches 76A and 76B are open and the switches 76C, 76D, 76E and 76F are closed, whereby electrodes 22A and 22B are nonenergized and electrodes 22C, 22D, 22E and 22F are energized, the resulting coating 82 (FIG. 5) is of substantially uniform thickness about the rectangular wire 74. In the preceding description of the advantages of the switching means, it is understood that the electrodes in array 22 are immersed in the fluidized bed relatively near the upper surface thereof as illustrated in FIG. 1.

The pulverulent material or powder used in the fluidized bed may have any suitable particle size. In general, particles having average diameter from about 3 to about 200 microns and preferably from about 3 to about 74 microns are found suitable. Beds formed of particles having a mixture of sizes are highly suitable.

Pulverulent materials useful herein include, in general, any electrically chargeable pulverulent material which sinters when heated. Resins are especially suitable herein. Suitable resins include, for example, epoxies, acrylics, phenolics, polyamides, polyesters, polyphenylene sulfides, and polyvinylidene fluorides. Epoxy or ethoxyline resins having especially desirable properties for electrical insulation are described in U.S. Pat. Nos. 2,324,483, 2,444,333, 2,494,295, 2,500,600 and 2,511,913, and similarly useful polyester resins are described in U.S. Pat. Nos. 2,936,296, and 2,889,304. A resin preferred herein is Alkanex® polyester resin, marketed by General Electric Company. Resins especially preferred herein are polyvinyl formal resins modified with phenol-formaldehyde resins and epoxy resins, preferably including a curing agent. The latter resins are described in copending application of Flowers, U.S. Ser. No. 697,838, filed June 21, 1976, assigned to the same assignee hereof, and incorporated herein by reference.

The furnace is operated at any temperature effective for fusing the applied powder layer to a uniform film. Where the applied powder is a heat curable resin, the furnace is operated at temperatures sufficient to sinter, flow, level, and cure the resin. Furnace temperature may be in the range from about 100° C. up to about 500° C. or the decomposition temperature of the applied powder, whichever is lower. In general, furnace temperatures from about 100° C. to about 300° C. are preferred.

Figure 7:
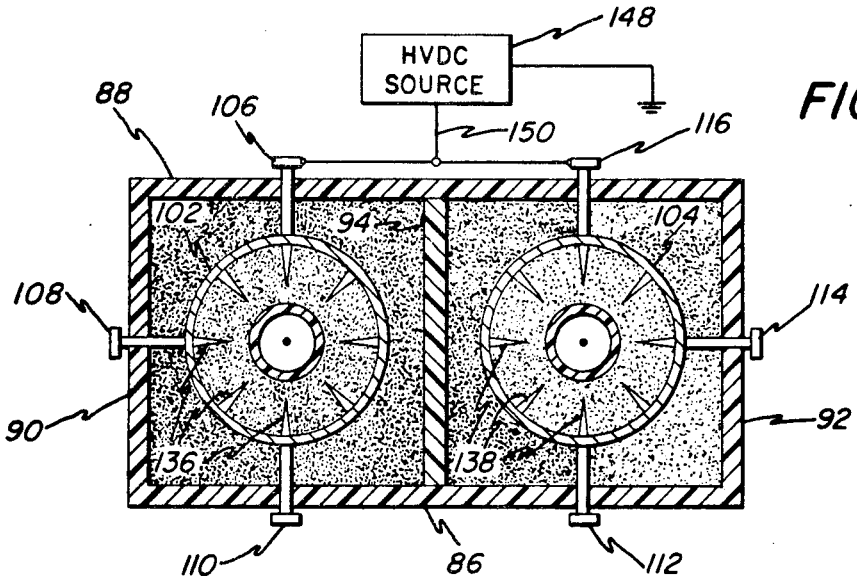
FIG. 7 is a sectional view taken on line 7—7 of FIG. 6.
Figure 6:
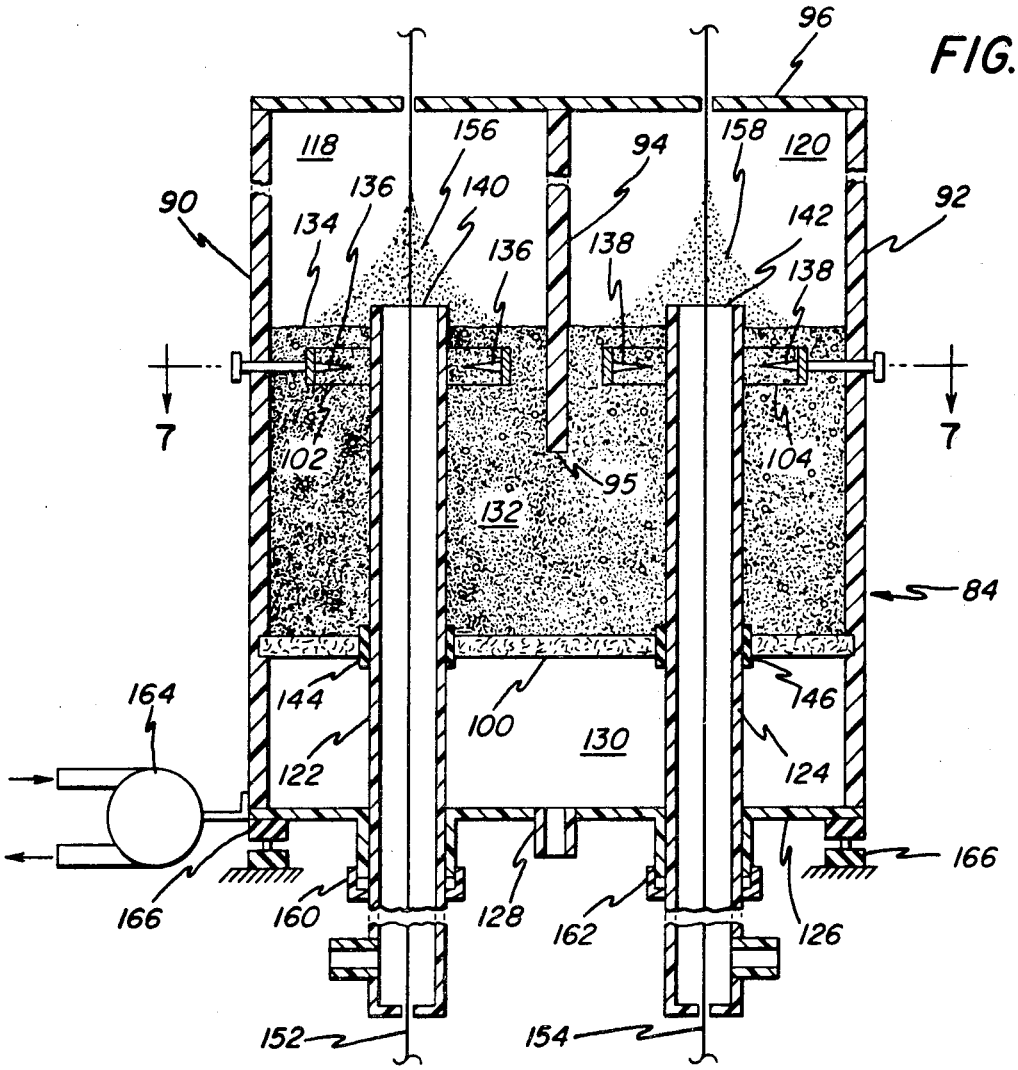
FIG. 6 is an elevation view, partly in section of another embodiment of the coating apparatus of this invention.

FIGS. 6 and 7 illustrate an embodiment of the present invention wherein a plurality of two or more elongate conductors can be coated simultaneously using a common bed. Therein shown is container 84 having side walls 86 and 88 connected at ends thereof by end walls 90 and 92. The container includes cover 96 atop the side and end walls and gas permeable false bottom plate 100 formed of porous material. Spaced apart electrode-bearing rings 102 and 104 may be disposed in generally coplanar manner, as illustrated, and mounted on supports 106, 108, 110, 112, 114 and 116 which are carried by the side and end walls. The electrode-bearing rings are disposed intermediate and spaced from the porous plate 100 and the cover and include a plurality of uniformly angularly disposed electrodes 136 and 138. The side walls are connected intermediate ends thereof by inner wall 94 extending downwardly from the cover and terminating in a lower end 95 which is spaced above the porous plate and preferably below the electrode-bearing rings as shown.

The inner wall or barrier 94 divides the upper portion of the container into two separate regions 118 and 120. Generally parallel spaced apart tubes 122 and 124 extend upwardly through bottom plate 126, through porous plate 100, through the electrode rings 102 and 104, and into regions or compartments 118 and 120, respectively. Dry fluidizing gas supplied, preferably at a low rae, from a source not shown through inlet 128 in the bottom plate passes through plenum chamber 130 and upwardly through the porous plate and fluidizes powder added to the container to provide fluidized bed 132. Sufficient powder is added such that when the bed is fluidized, the upper surface 134 of the fluidized bed is above the lower end of the inner wall, above the electrodes 136 and 138, and below the open upper ends 140 and 142 of the tubes.

The cover, walls and tubes are preferably formed of dielectric materials. The electrode rings, which are of electrically conductive material, may be electrically connected to the same or different high voltage D.C. sources. In the illustrated embodiment, the rings are connected to a common high voltage D.C. generator 148 through common lead 150 which is connected to electrically conductive supports 106 and 116. The container is preferably provided with vibrator 164 and shock absorbant supports 166.

In operation, while the bed is fluidized, electrically charged and preferably vibrated, wires 152 and 154 are passed over grounded pulleys (not shown) and upwardly through tubes 122 and 124, respectively. Charged particles 156 are attracted to wire 152 in region 118 and charged particles 158 are simultaneously attracted to wire 154 in region 120. If the inner wall 94 is omitted, it is found that irregular coatings with numerous bare spots are formed on the wires when simultaneous coating is attempted. However, it has unexpectedly been found that inclusion of the inner wall results in each wire simultaneously receiving a uniform continuous powder coating, which when fused in a furnace results in an excellent electrical insulation film about the corresponding wire.

If desired, either or both of the tubes may be received through compressible seal assemblies such as assemblies 160 and 162, each having a compressible seal interposed between a cap which is removably secured to a corresponding depending portion of bottom wall 126 in a manner similar to that described above for cap 64 and O-ring 62 for container 10 (FIG. 1). Thus, the tubes may be axially moved relative to the container for controlling the thickness of the applied coatings, as described above for container 10. Seals 144 and 146 disposed in openings in the porous plate slidably receive tubes 122 and 124, respectively, and substantially prevent the fluidizing gas from bypassing the porous plate.

Practice of the present invention is further illustrated by the following non-limiting examples. All parts and percentages given throughout this description are by weight unless otherwise indicated.

EXAMPLE 1

A wire coating operation was carried out using apparatus substantially as illustrated in FIG. 1. The inside diameter of the cylindrical container was 2 inches. The tube 18 had an inside diameter of 0.20 inch and an outside diameter of about 0.312 inch. The electrode array 22 (FIG. 2) was located 4 inches above the porous plate 16 which was of polyethylene and had a pore size of 25 microns. The electrodes were spaced 60° apart. The tips of the electrodes were all spaced one half inch from the axis of the tube.

A sufficient amount of fusible powder was added to the lower portion of the container to provide a bed depth of 3 inches. The powder was Alkanex® 81062 polyester resin (commercially available from General Electric Company) modified in accordance with an invention of Boldebuck and Gorowitz as next described. One hundred parts of the polyester resin, 0.25 part of tetrakis (2-ethylhexyl) titanate, and 0.25 part of FC-430 fluorocarbon (commercially available from the 3M Company) were added with stirring to 500 parts of methylene chloride. The resulting 20% solution was filtered sequentially through glass wool and a pressure filter containing filter pads with 5 micron pores. The filtrate was spray dried in nitrogen at 50° to 60° C. The resulting substantially solvent-free modified polyester resin particles were ball milled for 16 hours. Submicron fumed silica was added to the milled resin powder in an amount of 0.1 part of silica per 100 parts of the resin powder and the ingredients were uniformly blended by tumbling for 3 hours. The silica-resin blend was sieved through a 270 mesh (53 micron) screen. The particles having maximum diameter of 53 microns were used in the bed.

Dry nitrogen was passed upwardly through the porous plate at a rate of 1.5 standard cubic feed per hour (superficial gas velocity of about 0.02 feet per second) and the container was vibrated. The resulting fluid bed had a uniform upper surface at a height of 4.5 inches above the plate (0.5 inch above the electrodes). The height of the tube was adjusted to 0.5 inch above the fluid bed surface. The electrodes were energized by a negative D.C. potential of 8.25 kilovolts (kv).

Circular copper wire having a diameter of 36 mils was passed over the grounded pulley and upwardly through the center of the tube at a rate of 5 feet per minute. Two passes of the resulting powder coated wire were made at 5 feet per minute through the furnace which was 12 feet long and maintained at a temperature profile of 200° C. at the inlet end to 300° C. at the outlet end.

Essentially no powder was found in the exhaust fluidizing nitrogen.

The resulting fused and cured film coating was found to have good uniformity of thickness of about 1.75±0.25 mils and only 7 flaws per 100 feet as determined by a standard flaw detection test at 3 kilovolts.

EXAMPLE 2

The procedure of Example 1 was repeated except that electrode array 32 having the same configuration as the electrode array in Example 1 was disposed one inch below the porous plate and energized at minus 16 kilovolts; the tetrakis (2-ethylhexyl) titanate was included in an amount of 0.5 part per 100 parts of the polyester resin; and the silica-resin particles which passed a 400 mesh (53 micron) screen were used in the bed. Circular copper wire having a diameter of 40.3 mils was passed through the coating apparatus at 3 feet per minute. Two passes of the powder coated wire were made through the furnace which had a temperature profile ranging from a minimum of 170° C. (inlet end) to 300° C. (outlet end).

The resulting fused and cured film coating was found to have good uniformity of thickness of about 2.1±0.25 mils and only 8 flaws per 100 feet as determined by the 3 kv flaw detection test.

Examples 3 and 4 illustrate the effect of different tube heights above the fluidized bed on film thickness.

EXAMPLE 3

The procedure of Example 1 was repeated except that the voltage was minus 9 kilovolts, the wire had a diameter of 35.8 mils, and 0.5 part of FC-430 was added. The furnace was operated at an inlet temperature of 170 C. and an outlet temperature of 300° C. The resulting fused and cured film was substantially uniform in thickness (1.1–1.35 mils).

EXAMPLE 4

The procedure of Example 3 was repeated except that the tube height above the upper surface of the fluidized bed was increased from 0.5 to one inch. The resulting fused and cured film was substantially uniform in thickness (0.5–0.7 mil).

EXAMPLE 5

The procedure of Example 1 may be repeated except that the resin used is a polyvinyl formaldehyde resin modified with an epoxy resin and a phenolic resin, the blend being described in Example 5 of the above-cited application, U.S. Ser. No. 697,838, filed June 21, 1976.

An insulated wire having good electrical insulation properties with good hydrolytic stability is expected to result.

It is to be understood that the foregoing detailed description is given merely by way of illustration and that numerous modifications may be made therein without departing from the spirit or the scope of the present invention.

What we claim is:

1. A process for continuously applying a controlled thickness coating on an elongate electrical conductor, comprising the steps of (a) providing an upwardly extending hollow member having an upwardly facing port, (b) providing a bed of powder about said hollow member, (c) fluidizing said bed to an extent such that the upper surface of the bed is below the port, (d) electrically charging the fluidized bed with an electrical potential different from the electrical potential of the conductor by electrically charging electrode means disposed within said bed, (e) said conductor being a rectangular wire having an elongate cross-sectional shape including opposite narrow ends interconnected by a pair of elongate opposite sides, (f) disposing said electrode means in a angularly spaced apart, generally horizontal array with at least one charged electrode porjecting radially inwardly toward each elongate cross-section side of the rectangular wire and no electrode projecting inwardly toward either of said cross-sectional narrow sides, (g) advancing the conductor along a path through said hollow member and upwardly out of said port to effect coating of the powder onto the conductor, (h) adjusting the height of the port above the upper surface of the bed to control the thickness of the powder coating.

2. The process of claim 1, wherein the fluidizing step includes passing a gaseous medium upwardly through the bed at a sufficiently low rate to substantially avoid entrainment of powder by the gaseous medium in a zone above the bed.

3. The process of claim 2, further including the step of vibrating said bed while the steps of fluidizing and electrically charging and conductor advancing are being carried out.

4. The process of claim 1, wherein the powder is fusible and further including fusing the powder coating to form a film.

5. The process of claim 1, wherein the hollow member is a tube.

6. The process of claim 1, wherein the upper surface of the bed is at least 0.2 inch above said electrode means.

7. The process of claim 1, wherein said charging step is additionally carried out by electrically charging a gaseous medium exteriorly of the bed and said fluidizing step is carried out by passing the charged gaseous medium upwardly through the bed.

8. The process of claim 2, wherein said rate corresponds to a superficial velocity of said gaseous medium from about 0.01 to about 0.10 feet per second, the average diameter of the particles of said powder being from about 3 to about 200 microns.

9. The process of claim 8, wherein said superficial velocity is from about 0.01 to about 0.03 feet per second.

10. The process of claim 9, wherein said average diameter is from about 3 to about 74 microns.

11. The process of claim 1, wherein said plurality of charged electrodes is constituted by four charged electrodes so arranged that first and second pairs of adjacent inner ends thereof are at first and second pairs of adjacent apexes of a regular hexagon, each of the remaining two apexes separating said first and second apex pairs and being aligned with said opposite narrow ends of said rectangular wire.

12. The process of claim 1, wherein the ratio of cross-sectional length to cross-sectional width of said rectangular wire is 2:1 or more.

13. The process of claim 14, wherein the ratio of cross-sectional length to cross-sectional width of said rectangular wire is 2:1 or more.

14. The process of claim 1, further comprising the steps of (G) providing a second upwardly extending hollow member having a second upwardly facing port, (H) providing a second bed of powder about said second hollow member, (I) fluidizing said second bed to an extent such that the upper surface thereof is below said second port, (J) electrically charging the fluidized second bed with an electrical potential different from the electrical potential of a second elongate electrical conductor, (K) advancing said second conductor along a path through said second hollow member and upwardly out of said second port to effect coating of powder from said second bed onto said second conductor, (L) adjusting the height of said second port above the upper surface of said second fluidized bed to control the thickness of the powder coating on said second conductor, (M) containing said fluidized beds in a lower portion of a container having an upper portion where the coating of both conductors is effected, and (N) providing barrier means dividing said upper portion of the container into two separate regions such that each region is disposed above only one of said hollow member ports, said barrier means having a lower end spaced above a container member supporting the bed thereabove, said lower end of said barrier means being disposed lower than each of said ports, and wherein the fluidized first-mentioned bed and the fluidized second bed constitute adjoining portions of a common fluidized bed, whereby charged particles are transfered from said common fluidized bed to each conductor in the region of the upper portion of the container adjacently above the port of the hollow member through which such conductor is advanced.

15. A process for continuously coating an elongate electrical conductor, comprising the steps of (a) providing an upwardly extending hollow member having an upwardly facing port, (b) providing a plurality of horizontally spaced apart electrodes about said hollow member and near said port, (c) providing a bed of powder about said hollow member (d) fluidizing said bed to an extent such that the upper surface of the bed is intermediate the port and said electrodes, (e) electrically charging the electrodes with an electrical potential different from the electrical potential of the conductor, (f) advancing the conductor along a path through said hollow member and upwardly out of said port to effect coating of the powder onto the conductor, (g) providing a second upwardly extending hollow member having a second upwardly facing port, (h) providing a second plurality of horizontally spaced apart electrodes about said second hollow member and near said second port, (i) providing a second bed of powder about said second hollow member, (j) fluidizing said second bed to an extent such that the upper surface thereof is intermediate said second port and said electrodes of said second plurality, (k) electrically charging said plurality of electrodes with an electrical potential different from the electrical potential of a second elongate electrical conductor, (l) advancing said second conductor along a path through said second hollow member and upwardly out of said second port to effect coating of powder from said second bed onto said second conductor, (m) containing said fluidized bed in a lower portion of a container having an upper portion where the coating of both conductors is effected, (n) providing barrier means dividing said upper portion of the container into two separate regions such that each region is disposed above only one of said hollow member portions, said barrier means having a lower end spaced above a lower member of the container, said member supporting the beds thereabove, said lower end of said barrier means being disposed lower than each of said ports, and wherein the fluidized first-mention bed and the fluidized second bed constitute adjoining portions of a common fluidized bed, whereby charged particles are transferred from said common fluidized bed to each conductor in the region of the upper portion of the container adjacently above the port of the hollow member through which such conductor is advanced.

16. The process of claim 15, wherein each conductor is wire having circular cross-section, each electrode means includes a generally horizontal array of a plurality of angularly spaced apart electrically charged electrodes, each hollow member is a substantially vertical tube extending upwardly through a different one of the arrays, each electrode of each array projecting inwardly toward one of said tubes, the angular spacing between each pair of adjacent electrodes in each array is uniform, the radial distance from each tube to the inner end of each electrode in the array through which such tube extends is the same, and the inner ends of the electrodes of each array are at apexes of a regular polygon, the advance of each wire being through the center of the tube through which such wire is advanced.

17. The process of claim 16, wherein each array comprises six charged electrodes, and the inner ends of said six electrodes are at the apexes of a regular hexagon.

18. The process of claim 15, wherein each conductor is rectangular wire having an elongate cross-sectional shape including opposite narrow ends interconnected by a pair of elongate opposite sides, each electrode means includes a generally horizontal array of angularly spaced apart electrically charged electrodes, each hollow member is a substantially vertical tube extending upwardly through a different one of the arrays, at least one charged electrode of each array projecting radially inwardly toward each elongate cross-section side of the rectangular wire being advanced through the tube extending through such array with no charged electrode projecting inwardly toward either of the narrow ends of such rectangular wire.

19. The process of claim 18, wherein each array of charged electrodes is constituted by four charged electrodes so arranged that first and second pairs of adjacent inner ends thereof are at first and second pairs of adjacent apexes of regular hexagon, each of the remaining two apexes separating said first and second apex pairs and being aligned with the opposite narrow ends of the rectangular wire being advanced through the tube extending through such array.

20. The process of claim 18, wherein the ratio of cross-sectional length to cross-sectional width of each rectangular wire is 2:1 or more.

21. The process of claim 19, wherein the ratio of cross-sectional length to cross-sectional width of each rectangular wire is 2:1 or more.

22. The process of claim 15, further including adjusting the height of each port above the upper surface of the common fluidized bed to control the thickness of the powder coating on the conductor advanced out of such port.

23. The process of claim 15, wherein each hollow member is substantially vertical.

24. The process of claim 23, further including adjusting the height of each port above the upper surface of the common fluidized bed to control the thickness of the powder coating on the conductor advanced out of such port.

* * * * *